US005651163A

United States Patent [19]

Tamaki

[11] Patent Number: 5,651,163

[45] Date of Patent: Jul. 29, 1997

[54] DOOR HANDLE DEVICE

[75] Inventor: Yasuyuki Tamaki, Tokai, Japan

[73] Assignee: Sakae Riken Kogyo Co., Ltd., Aichi Prefecture, Japan

[21] Appl. No.: 462,066

[22] Filed: Jun. 5, 1995

[30] Foreign Application Priority Data

Jun. 15, 1994 [JP] Japan ..... 6-158116

[51] Int. Cl.[6] ..... B25G 1/00

[52] U.S. Cl. ..... 16/112; 74/543

[58] Field of Search ..... 16/110 R, 112, 16/124, 126, DIG. 25; 292/336.3, DIG. 30, DIG. 63, DIG. 67; 74/543; 220/766

[56] References Cited

U.S. PATENT DOCUMENTS 4,892,342 1/1990 Newman ..... 292/336.3

OTHER PUBLICATIONS

JP Laying–open Gazette No. 1–278835/89, Nov. 1989.
JP Laying–open Gazette No. 1–299966/89, Dec. 1989.
JP Laying–open Gazette No. 1–299967/89, Dec. 1989.

*Primary Examiner*—Chuck Y. Mah
*Assistant Examiner*—Donald M. Gurley
*Attorney, Agent, or Firm*—Larson and Taylor

[57] ABSTRACT

A door handle device including a handle body which is manipulated when a vehicle door is opened and closed, a case for receiving the handle body and mounted on the vehicle door, and a spring disposed between the case and the handle body and adapted to exert a return force to the handle body. The handle body includes a handle portion and a lever, the lever being provided at one end thereof with a cylindrical projection served as a hinge pin. The handle body thus constructed is integrally formed of a plastic material. The case, in which the handle body is received, includes a base mounted on the side of the vehicle door, a column-like stay mounted on the base and a spring retainer portion for retaining the spring, the stay is provided with a part thereof with an engaging portion into which the projection of the lever is fitted for engagement. A cut-out groove is continuous with the engaging portion and has an overhang portion with respect to a configuration of the engaging portion. The case thus constructed is also integrally formed of a plastic material, the projection formed on the lever of the handle body being brought into engagement with the engaging portion formed on the stay of the case, thereby attaching the handle body to the case.

4 Claims, 4 Drawing Sheets

DOOR HANDLE DEVICE

BACKGROUND OF THE INVENTION

As shown in FIG. 6, a conventional door handle device for vehicles includes a case (20) attached to a door outer plate of a vehicle and a handle (10) received in a recess portion (220) of the case (20). A right and a left levers (110), (110') disposed at the handle (10) and a right and a left stay (210), (210') disposed at the case (20) are connected through a metal hinge pin (50), thereby forming an outer door handle. A spring (30) constituted of a coil spring is attached so that the stays (210), (210') and the levers (110), (110') are rotatably connected to each other through a hinge pin (50). Under the effect of this spring (30), a return force acts on the handle (10) in such a manner as to return the handle (10) to its original position when the handle (10) is manipulated. For attaching the hinge pin (50), a mounting hole of the stay (210) is brought into alignment with a mounting hole of the lever (110), and then, the hinge pin (50) is inserted into the mounting hole from one side all the way through the other side. Since the insertion of the hinge pin (50) must be performed over a long span (L), the assembling work of the overall door handle device becomes complicated and the assembling efficiency is lowered. In order to prevent the hinge pin (50) from coming off after the hinge pin (50) is attached, the hinge pin (50) is provided with a crushed portion (510') crushed by a hammer and a depressed portion (510) which are formed in an area around the stay (210'). However, the task for forming the crushed portion (510') and depressed portion (510) also causes the assembling efficiency to be lowered.

SUMMARY OF THE INVENTION

This invention relates to a door handle device for vehicles and more particularly to an outer door handle. A metal hinge pin conventionally used in a hinge joint portion between a case and a handle, is eliminated. The case and the handle are integrally formed from a plastic material.

It is, therefore, an object of the present invention to provide a novel door handle device capable of solving the problem inherent in a conventional door handle device which requires a complicated assembling work for rotatably connecting a stay portion of a case to a lever portion of a handle through a metal hinge pin separately situated, in a hinge jointed portion between the case and the handle.

This object can be achieved by providing a door handle device including a handle body which is manipulated when a vehicle door is opened and closed, a case for receiving the handle body and mounted on the vehicle door, and a spring disposed between the case and the handle body and adapted to exert a return force to the handle body, wherein the handle body comprising a handle portion and a lever, the lever being provided at one end thereof with a cylindrical projection served as a hinge pin, the handle body thus constructed being integrally formed of a plastic material, on the other hand, the case, in which the handle body is received, comprising a base mounted on the side of the vehicle door, a column-like stay mounted on the base and a spring retainer portion for retaining the spring, the stay being provided with a part thereof with an engaging portion into which the protection of the lever is fitted for engagement, and a cut-out groove continuous with the engaging portion and having an overhang portion with respect to a configuration of the engaging portion, the case thus constructed being also integrally formed of a plastic material, the projection formed on the lever of the handle body being brought into engagement with the engaging portion formed on the stay of the case, thereby attaching the handle body to the case.

Another object of the present invention is to provide a door handle device in which the number of parts can be reduced without using a hinge pin made of a metal material, as a separate part as in the conventional door handle device.

These objects can be achieved by a construction of a door handle which constitutes the present invention. Specific embodiments of the present invention will be exemplified in the accompanying drawings and in the detailed description to follow. It should be noted that minor corrections and modifications thereof are included in the scope of appended claims.

DETAILED DESCRIPTION OF THE INVENTION

Figure 1:
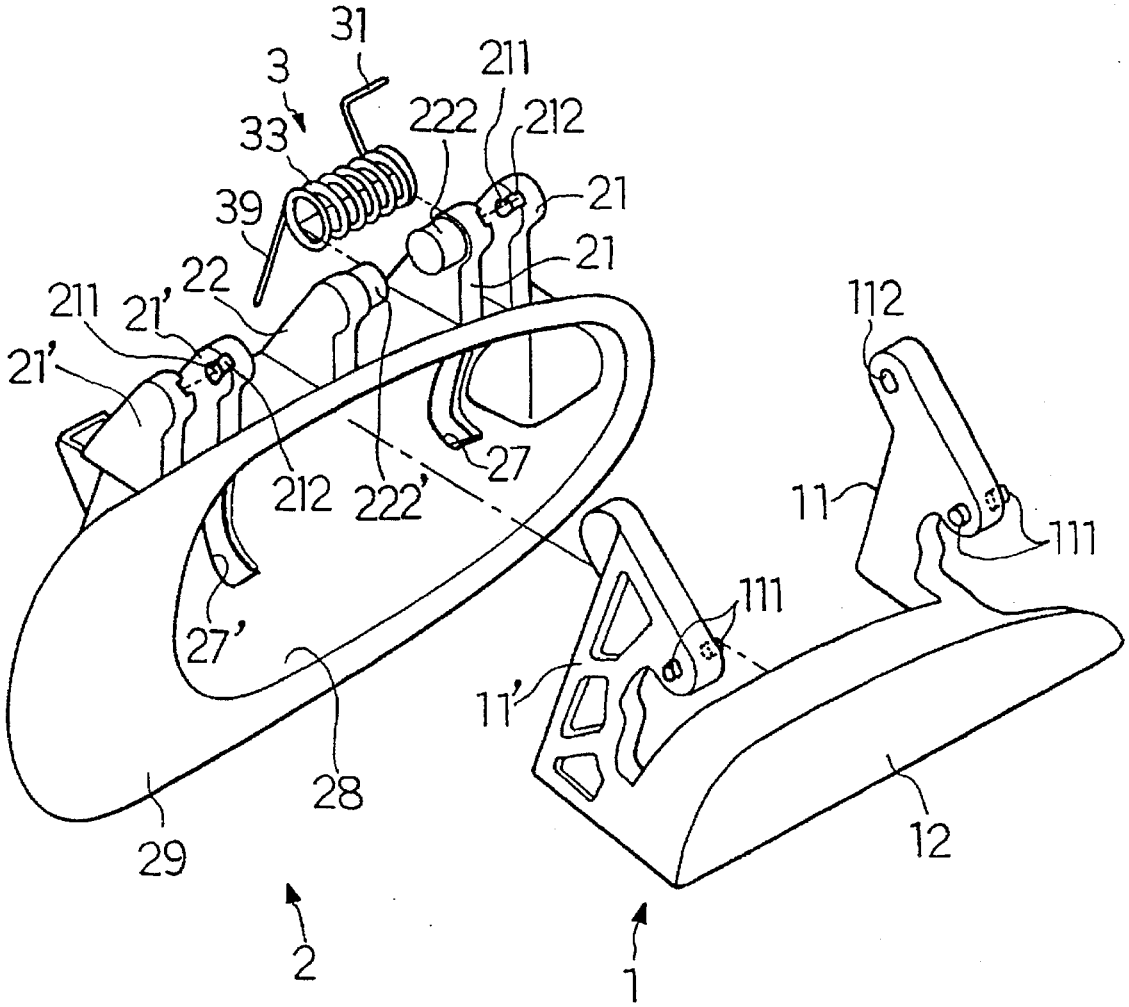
FIG. 1 is an exploded perspective view showing an overall construction of a door handle device according to the present invention.

As shown in FIG. 1, a construction of one embodiment of the present invention comprises a handle body (1) which is manipulated when a door is opened/closed, a case (2) for receiving the handle body (1) so that an overall door handle device is attached to an outer plate of the vehicle door, and a spring (3) disposed between the case (2) and the handle body (1) and adapted to provide a returning force to the handle body (1) so that the handle body (1) will be returned into the case (2). The handle body (1) comprises a handle portion (12) having a flat surface flush with the base (29) of the case (2), a pair of L-shaped levers (11), (11') projecting from generally opposite end portions of the handle portion (12). A cylindrical projection (111) is formed on a distal end portion of each of the levers (11), (11'). The cylindrical projection (111) projects from opposite sides of each of the lever (11), (11'). The overall handle body (1) is integrally formed from a plastic material.

On the other hand, the case (2) to be received in the handle body (1) comprises a base (29) coplanar with the handle portion (12) of the handle body (1), and a recess portion (28) like a bottom of a vessel is formed in a central portion of the base (29). The handle portion (12) of the handle body (1) is received in the recess portion (28). Cut-outs (27), (27') are formed in an area in the vicinity of opposite end portions of the recess portion (28). The levers (11), (11') are received in the cut-outs (27), (27'), respectively. The case (2) further comprises a pair of column-like stays (21), (21') located in outer positions of the recess portion (28) and projected from outer positions of the recess portion (28), respectively, and a spring retainer portion (22) formed in the center of an area between the stays (21), (21'). The above parts constituting the case (2) are also integrally formed from a plastic material.

Figure 2:
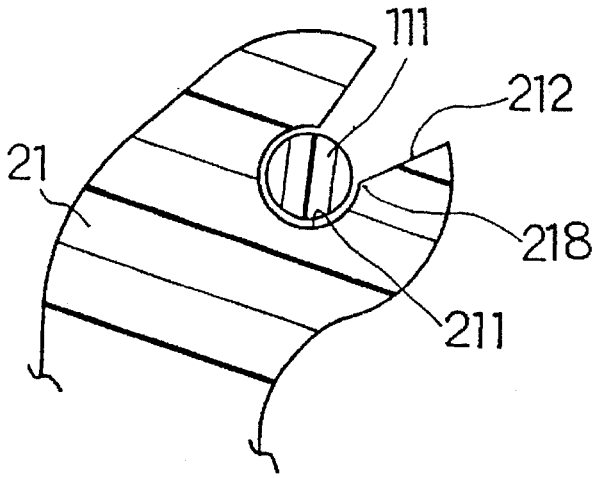
FIG. 2 is a cross-sectional view showing a construction of a hinge joint portion between a handle body and a case, according to the present invention.
Figure 3:
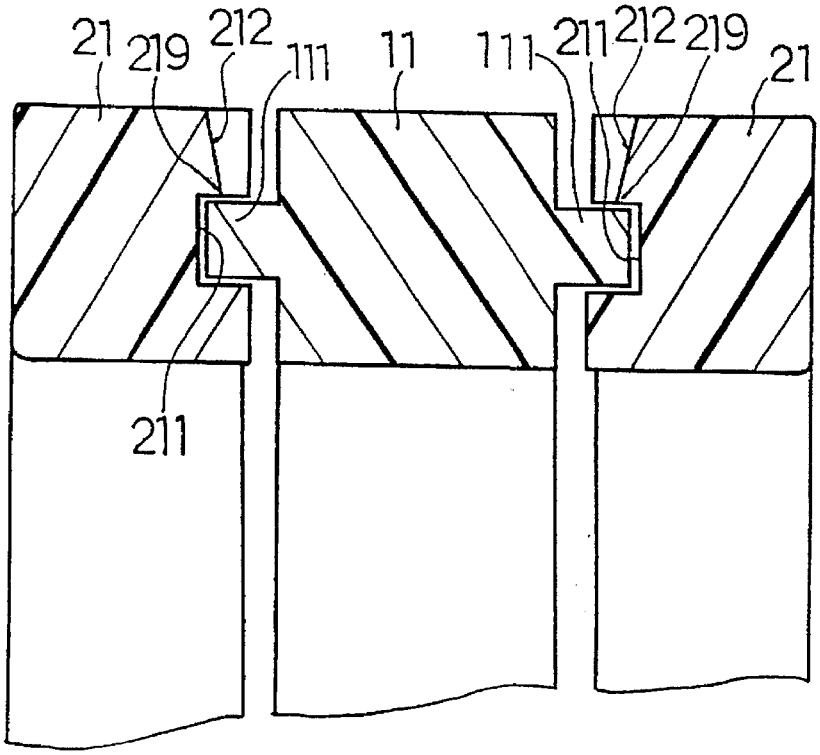
FIG. 3 is an enlarged partly vertical-sectional view showing a construction of a hinge joint portion between a handle body and a case, according to the present invention.

Specifically, the stays (21), (21') are raised upwardly, side by side, with the cut-outs (27), (27') sandwiched therebetween. When the handle body (1) is attached to the case (2), the levers (11), (11') are sandwiched between the stays (21), (21'). A cut-out groove (212) is formed in a distal end of each of the stays (21), (21'). An engaging portion (211) is continuous with each cutout groove (212). The projection (111) formed on the distal end of each lever (11), (11') of the handle body (1) is fitted for engagement in the engaging portion (211). A first overhang portion (218) is formed in the cut-out groove (212) as shown in FIG. 2. Also, a second overhang portion (219) is formed in the cut-out portion (212) as shown in FIG. 3. It should be noted, however, that it suffices as long as at least one of the first and second overhang portions (218), (219) is formed in the cut-out groove (212).

Of all the first and second overhang portions (218), (219), the first overhang portion (218), which is formed in the radial direction of the projection (111) as shown in FIG. 2, is designed smaller than the diameter of the projection (111). Owing to this feature, when the projection (111) is once inserted for engagement in the engaging portion (211), the projection (111) is not disengaged from the engaging portion (211). This is true also to the second overhang portion (219) in which the projection (111) is formed in the longitudinal direction (axial direction) of the projection (111). Owing to the function of the first overhang portion (218), second overhang portion (219) and cut-out groove (212), the projections (111) formed on the distal end portions of the levers (11), (11') are easily inserted for engagement in the engaging portions (211) formed in the distal end portions of the stays (21), (21'), respectively, and the projections (111), when once inserted, is not disengaged.

Figure 5:
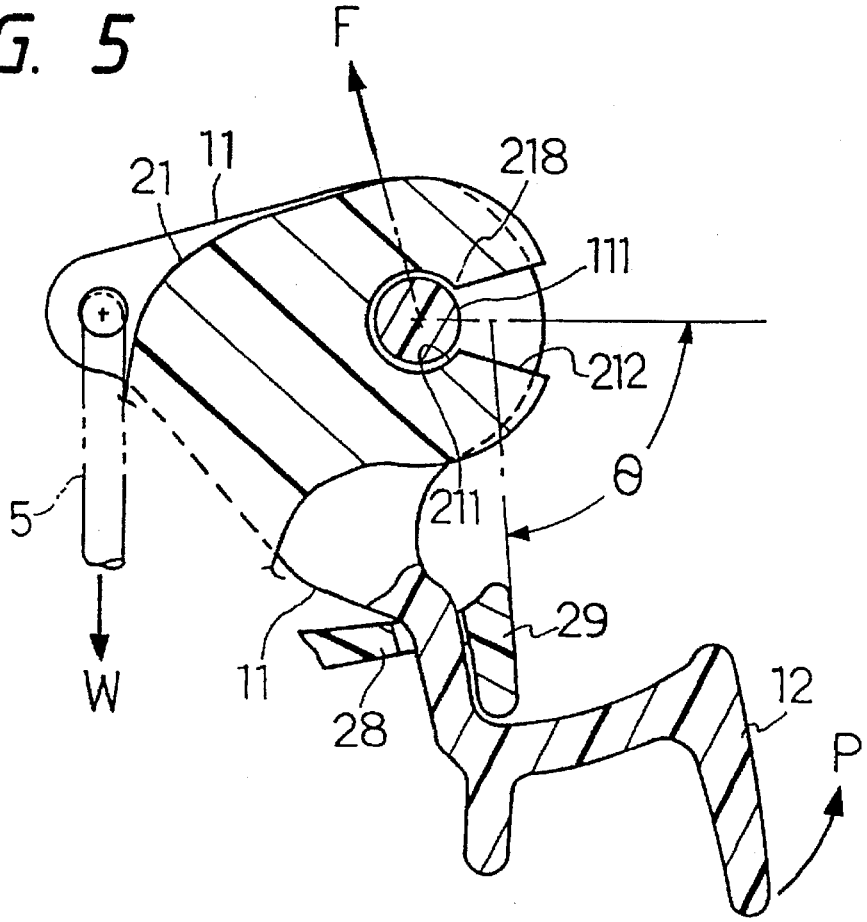
FIG. 5 is an explanatory view for explaining the action between a handle lever and a case stay when a handle body according to the present invention is manipulated.

As shown in FIG. 5, when the handle body (1) is manipulated, in other words, when a manipulation force P is applied to the handle portion (12) in a direction as indicated by an arrow, a reaction force W as indicated by an arrow is applied to a point of connection of a rod (5) connected to a door lock device (not shown) at the distal end portion of the lever (11) of the handle body (1) so that the lever (11) is turned about the projection (111). Owing to the manipulation force P and the reaction force W, the direction of the force F acting on the projection (111) as a supporting point is different in phase by 90 degrees with respect to the opening direction of the cut-out groove (212). That is, the opening direction of the cut-out groove (212) is generally perpendicular to a plane of the base (29) where the stay (21) having the cut-out groove (212) is formed. Therefore, in FIG. 5, the value of an angle $\Theta$formed between the opening direction of the cut-out groove (212) and the plane of the base (29) is 90 degrees or less. That is, the opening direction of the cut-out groove (212) is set such that an expression $\Theta \leqq 90$ degrees is satisfied.

With the above-mentioned construction, the spring retainer portion (22) is raised upwardly in the outer position of the recess portion (28) and side by side with the stays (21), (21'), in the center of the area between the stays (21), (21') [see FIG. 1]. In this spring retainer portion (22) and the stay (21) opposite to the spring retainer portion (22), spring holders (222), (222') for supporting a coil portion (33) of the spring (3) is disposed.

Figure 4:
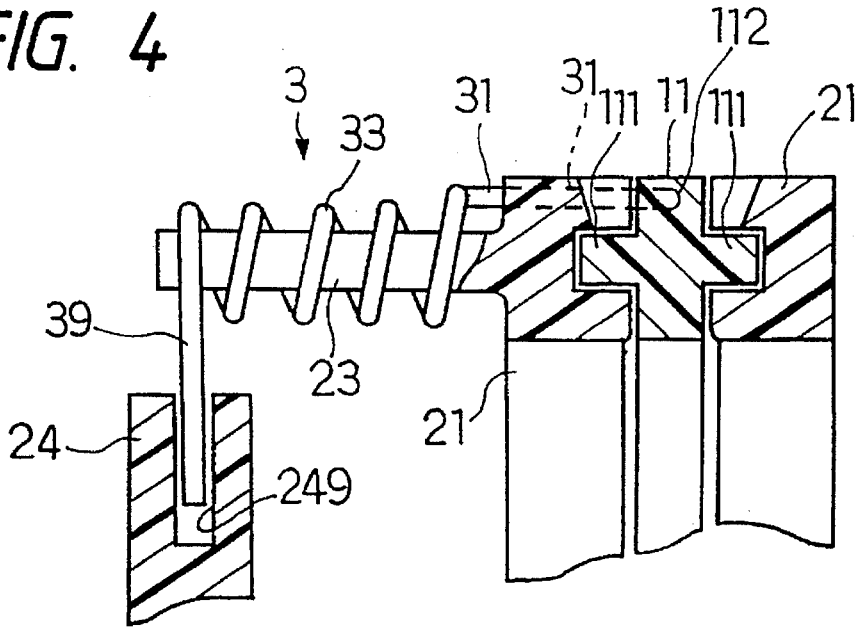
FIG. 4 is an enlarged partly vertical-sectional view showing another example of a construction of a spring retainer portion according to the present invention.

As another example of the spring retainer portion, there is illustrated a construction shown in FIG. 4, in which a spring holder (23) for supporting the coil portion (33) of the spring (3) is formed on one part of the stay (21) in a cantilevered fashion. A spring engaging portion (24) is separately situated such that the spring engaging portion (24) is raised upwardly from the outer position of the recess portion (28) which is like a bottom of a vessel. The spring engaging portion (24) is adapted to support a left end portion (39) of the spring (3). The left end portion (39) of the spring (3) is in engagement with an engaging groove (249) of the spring engaging portion (24).

The spring (3) retained or held by the spring holders (222), (222') shown in FIG. 1 and the spring holder (23) and spring engaging portion (24) shown in FIG. 4, has the coil spring portion (33). The left end portion (39) of the coil portion (33) is engaged with the spring engaging portion (24) [backside of the case (2) in the example of FIG. 1]in FIG. 4 as previously mentioned, whereas the right end portion (31) is engaged with the spring engaging hole (112) which is formed in the distal end portion of the lever (11).

For assembling the door handle device, the handle body (1) and the case (2) are assembled first. Specifically, for integrally assembling the handle body (1) and the case (2), the L-shaped levers (11), (11'), which are formed on opposite end portions of the handle body (1), are inserted in the cut-out portions (27), (27'), which are formed in the recess portion (28) which is like a bottom of a vessel, of the case (2) shown in FIG. 1. In the foregoing state, the projections (111) formed on the distal end portions of the levers (11), (11') are press-fitted in the engaging portions (211) formed in the distal end portions of the stays (21), (21') through the cut-out groove (212) as shown in FIGS. 2 and 3. Since the first overhang portion (218) is formed in the cut-out groove (212) in FIG. 2 and since the second overhang portion (219) is formed in the cut-out groove (212) in FIG. 3, a large press-in force could be required for over-riding the first and second overhang portions (218) and (219) when the projections (111) are fitted in the engaging portions (211).

Here, the stays (21), (21') of the case (2) are made from a plastic material. Since the stays (21), (21') can be elastically deformed, the handle body (1) and the case (2) can be easily integrally formed by pushing the projections (111) formed on the distal end portions of the levers (11), (11') into the engaging portions (211) formed on the distal end portions of the stays (21), (21'). As a result of this fitting operation, a hinge joint is formed between the stays (21), (21') and the levers (11), (11'). In such a jointed and integrated state, the spring (3) with its compressed coil portion (33) is loaded between the spring holders (222), (222') disposed at the stay (21) and the spring holder (22) as shown in FIG. 1.

Figure 6:
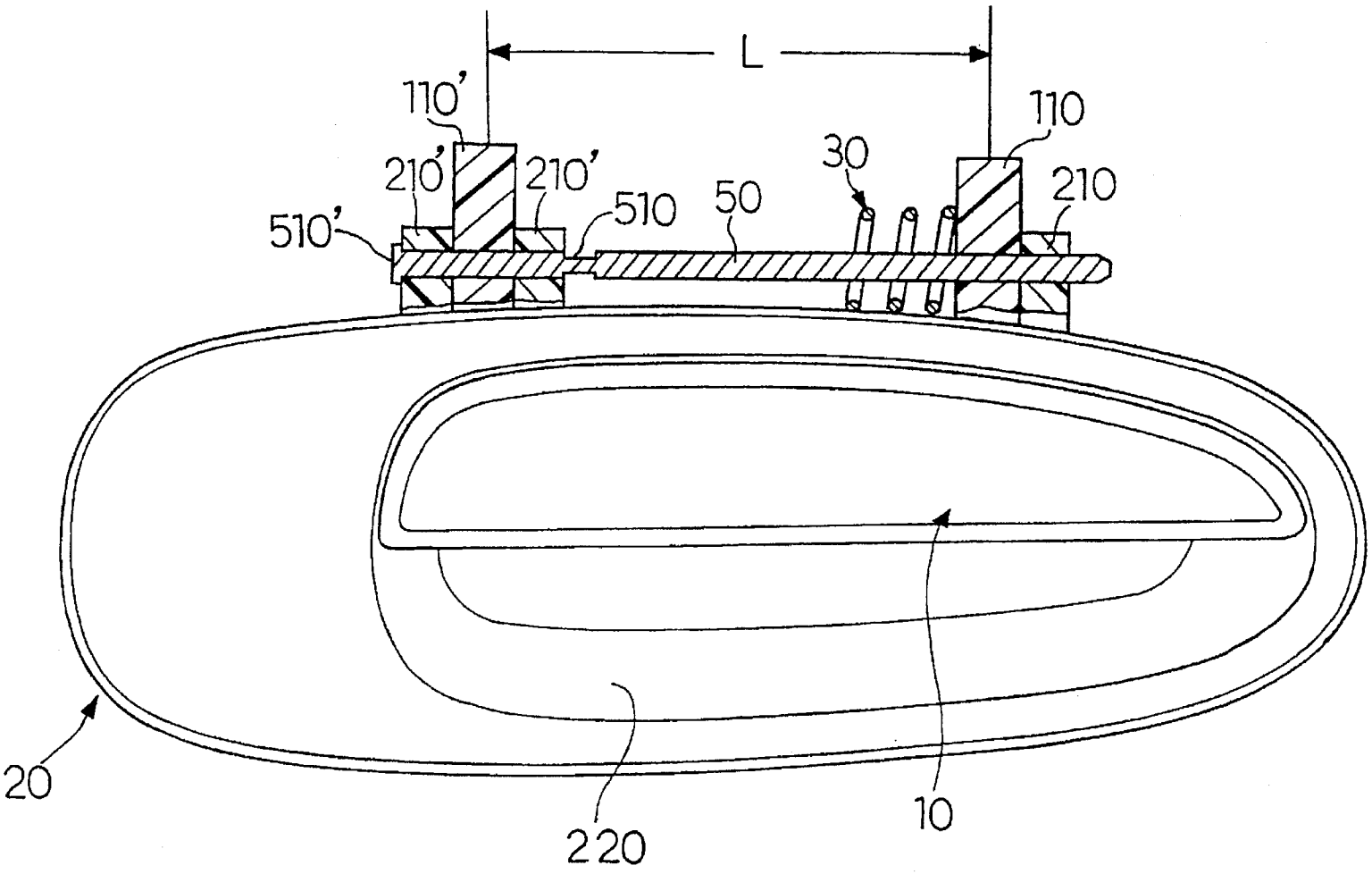
FIG. 6 PRIOR ART
FIG. 6 is a perspective view, partly in section, showing an overall construction of the conventional door handle.

In such a series of assembling and attaching works, according to the present invention, there is no provision of the metal hinge pin (50) which is needed as a separate body in the conventional device shown in FIG. 6. Accordingly, there can be eliminated the afore-mentioned problem associated with the troublesome work for attaching the hinge pin (50). As a consequence, the work for assembling the handle body (1) and the case (2) becomes easy. Consequently, the efficiency of the assembling work can be improved. Also, the tools required for attaching the hinge pin (50) as in the conventional device becomes unnecessary.

As previously mentioned, the first and second overhang portions (218), (219) are provided around the engaging portions (211) of the stays (21), (21') in which the projections (11) formed on the distal end portions of the levers (11), (11') are inserted and engaged. Owing to the function of the first and second overhang portions (218), (219), the projections (111) are not easily disengaged from the engaging portions (211).

As shown in FIG. 5, when the handle body (1) is manipulated and the force P is applied to the handle portion (12) in the direction as indicated by an arrow, the force P is acted on various parts in operative connection, as apparent from FIG. 5. Since the direction of the force F acting on the projections (111) of the levers (11), (11') and the opening direction of the cut-out groove (22) are different by about 90 degrees from each other, the projections (111) are not disengaged from the case (2) during the manipulation of the handle body (1).

For mounting the handle body (1) in the case (2), i.e., for integrally forming the handle body (1) and the case (2), the projections (111) formed on the distal end portions of the levers (11), (11') are pushed for engagement into the engaging portions (211) formed on the distal end portions of the stays (21), (21'). By doing this, the handle body (1) and the case (2) can be easily attached together. Since the stays (21), (21') having the engaging portions (211) are made from a plastic material, this attaching work can be easily made utilizing their elastic properties. When one attached, the projections (111) of the levers (11), (11') are not easily disengaged from the engaging portions (211).

According to the present invention, the handle body and the case can be connected without using a metal hinge pin which is needed in the conventional device. Consequently, the efficiency of the assembling work can be improved. It is not required to prepare a complicated tool or tools for such an assembling work. Further, since the metal hinge pin is no more required as previously mentioned, the number of parts can be reduced. Therefore, various costs including parts management costs can be reduced and thus, the costs of the overall door handle device can be reduced, too. Moreover, since the number of parts can be reduced, the weight can be reduced, too.

What is claimed is:

1. A door handle device comprising:

a handle body constructed integrally of a plastic material which is manipulated when a vehicle door is opened and closed, wherein said handle body includes a handle portion having a flat surface, and a pair of L-shaped levers projecting from opposite end portions of said handle portion, each said lever being provided at a distal end thereof with a pair of oppositely directed cylindrical projections serving as a hinge pin for the respective said lever;

a spring; and a case for receiving said handle body and which is integrally formed of a plastic material and which is mounted on the vehicle door, wherein said case includes a base having a base surface coplanar with said flat surface of said handle portion of said handle body and having a central recess portion formed like a bottom of a vessel, said central recess including a cut-out adjacent each respective opposite end portion thereof such that each respective said lever is inserted through a respective said cut-out, two sets of paired column-like stays, each respective said set of the paired stays being mounted adjacent a respective opposite end portion of said recess portion, and each respective said stay of each said set of the paired stays including (a) an engaging portion into which a respective said projection of an associated said lever is fitted for engagement, and (b) a cut-out groove continuous with said engaging portion such that a respective said projection is brought into engagement with the respective said engaging portion along said cut-out groove, said cut-out groove having an overhanging portion which retains the associated said projection in the associated said engaging portion and hence which attaches said handle body to said case, and a spring holder on which said spring disposed to exert a return force on said handle body.

2. A door handle device as claimed in claim 1, wherein said cut-out groove is formed in a distal end of said stay and is opened in a generally perpendicular direction to the base surface of said base.

3. A door handle device as claimed in claim 1 wherein said spring holder extends from one of said stays, and wherein said case further includes a spring retainer portion having a second spring holder extending therefrom opposite to said first-mentioned spring holder such that spring is disposed between said first spring holder and said second spring holder.

4. A door handle device as claimed in claim 1 wherein said spring holder extends cantilevered fashion from one of said stays, and wherein said case further includes a spring engaging portion having an engaging groove in which an end of said spring mounted on said spring holder is engaged such that another end of said spring exerts a force on said handle body.

* * * * *